United States Patent [19]

Massey

[11] 4,268,917

[45] May 26, 1981

[54] VARIABLY WEIGHTED VEST

[76] Inventor: Emmett B. Massey, P.O. Box 685, Concord, N.C. 28025

[21] Appl. No.: 40,185

[22] Filed: May 18, 1979

[51] Int. Cl.[3] ..... A41D 1/04; A41D 1/00; A63B 21/12

[52] U.S. Cl. ..... 2/102; 2/94; 272/119

[58] Field of Search ..... 2/102, 2.5, 94; 272/119, 121, DIG. 4, 76; 35/29 D

[56] References Cited

U.S. PATENT DOCUMENTS

| | | | |
|---|---|---|---|
| 891,932 | 6/1908 | Henderson | 2/102 |
| 1,486,676 | 3/1924 | Nilssen | 2/102 |
| 2,640,987 | 6/1953 | Ehlers | 2/2.5 |
| 3,427,020 | 2/1969 | Montour | 272/119 |

FOREIGN PATENT DOCUMENTS

| | | | |
|---|---|---|---|
| 930754 | 7/1973 | Canada | 272/119 |
| 218063 | 1/1968 | Sweden | 2/102 UX |

*Primary Examiner*—Doris L. Troutman
*Attorney, Agent, or Firm*—Clifton T. Hunt

[57] ABSTRACT

A variably weighted vest is provided for use in exercise, such as jogging, skating, bicycling and horseback riding. The vest is preferably provided with a plurality of pockets for the reception of commonly available material such as sand, pebbles, small stones, or even coins. The pockets are deep and large enough to hold, for example, approximately thirty pounds of weight and may be lightened as desired by the removal of an appropriate amount of the material used as weights. In one preferred embodiment a plurality of elongated tubular ribs are provided to minimize lateral shifting of the weight in use. In another preferred embodiment a single large pocket is provided across the back of the vest and a smaller pocket on each side of the front of the vest. The variably weighted vest according to the invention is relatively loose fitting so as to permit maximum comfort and body movement as compared with weighted garments of the prior art.

10 Claims, 9 Drawing Figures

VARIABLY WEIGHTED VEST

BACKGROUND OF THE INVENTION

Swedish Pat. No. 218,063 published Jan. 2, 1968 and entitled MEDICAL TRAINING GARMENT is the most pertinent prior art known to applicant. The Swedish Patent discloses a medical training garment designed to fit tightly and firmly to the body by means of adjustable resilient straps extending along the sides of the garment and a tightly laced slit opening extending downwardly from the front neckline of the garment. The prior art garment has a plurality of vertically extending long pockets across the back of the garment and on each side of the upper part of the front of the garment. Another series of horizontal pockets extend across the front of the garment below its waist portion.

The Swedish Patent notes that it may be satisfactorily used by healthy individuals but it is particularly intended for the therapeutic treatment of certain circulatory dysfunctions, vasoregulatory asthenia, narrow circulatory vessels, neurocirculatory asthenia, and the like. The Swedish Patent emphasizes that the weights are placed in such a manner that the center of gravity remains unchanged laterally and also emphasizes that the garment may be worn under another garment such as an overcoat or jacket.

In summary, the weighted garment disclosed by the Swedish patent is a relatively tight fitted, elongated garment extending below the waist and which permits only limited movement of the body, the emphasis being on maintaining the center of gravity of the body in the same or approximately the same vertical line as that of the unweighted body to facilitate use of the garment for therapeutic purposes in treating certain medical disorders.

SUMMARY OF THE INVENTION

The weighted vest, according to the invention, does not extend below the waist of the body so that bending of the waist is not handicapped by wearing of the weighted vest. The variably weighted vest of this invention is full bodied and purposely loose fitting to enable the wearer to shift all parts of the body while wearing the vest without restraint. The vest is closed at the sides as by short rows of stitches (about an inch or two long) or by one or more rivets shortly spaced above the lower edge of the vest and between the bustline and the waistline of the body. The front center of the vest is open but is closable by a thong extending through eyelets on opposite sides of the vest. Preferably only two opposed eyelets are fastened together although three eyelets are provided on each side so the fit of the vest may be adjusted as desired.

The weight containing pockets of the vest according to one embodiment of the invention comprise a plurality of elongated tubular ribs or pockets across the back of the vest and on each side of the front of the vest. All of the ribs on the back of the vest have a common access closable as by a horizontally extending zipper and a similar arrangement is used on each side of the front of the vest.

In another embodiment of the invention a single pocket extends across the back of the vest and a single pocket down each side of the front of the vest. Again, each pocket is closable by a single flap which may be fastened by a zipper or buckle or other similar means.

The vest of the first embodiment is particularly intended for use by healthy persons engaged in exercise, such as jogging, cycling, skating and riding horseback, and the second embodiment by athletes in training for contests such as boxing, football, and the like. The provision of a single pocket across the back and single pockets on each side of the front of the vest is preferable in situations where the wearer will be assuming a variety of positions, such as in football practice. The elongated tubular pockets are preferred in circumstances where the wearer will be primarily erect, as in jogging and where it is desired to limit lateral movement of the weights.

DETAILED DESCRIPTION OF THE INVENTION

Figure 2:
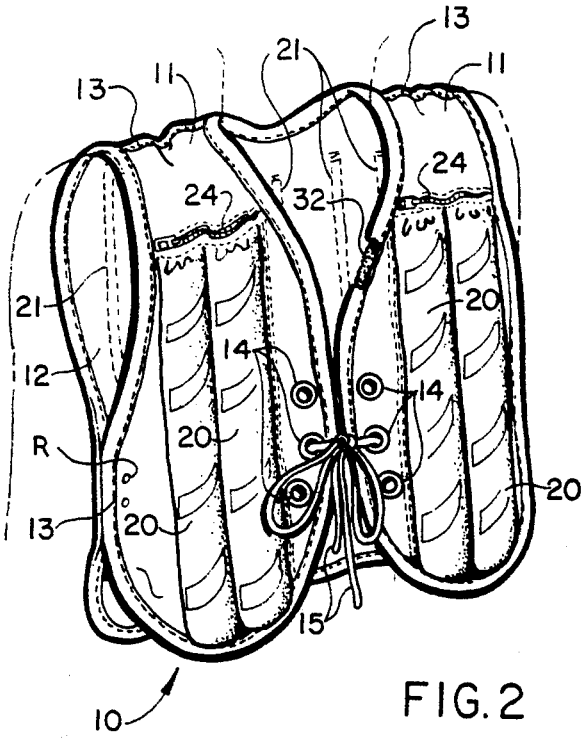
FIG. 2 is a perspective view looking at the front of a first embodiment of the vest showing the wearer outlined in phantom lines.
Figure 1:
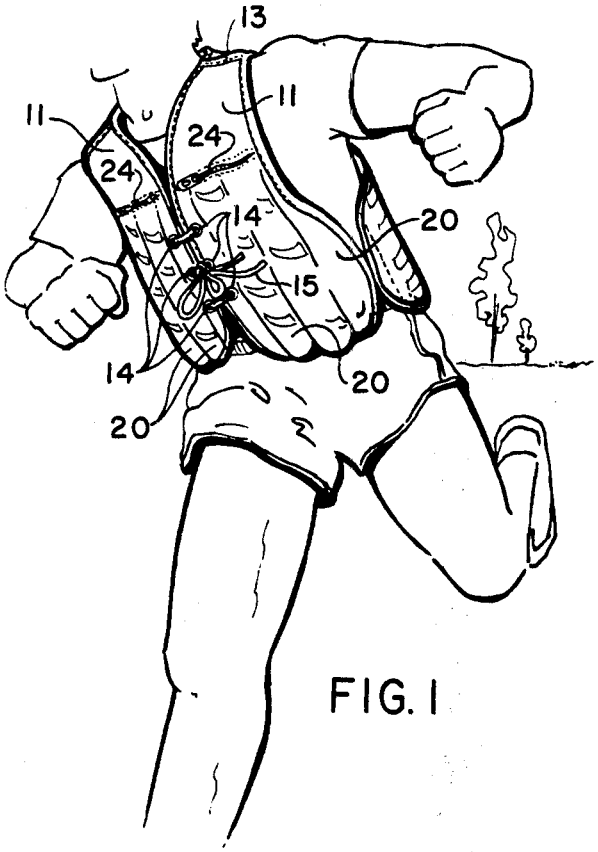
FIG. 1 is a perspective view of a jogger wearing the variably weighted vest.

Referring more specifically to the drawings, a variably weighted vest is broadly indicated at 10. The vest 10 includes a front panel 11 and a rear panel 12 stitched or otherwise secured together as at 13 along their adjoining top and side portions. The front of the vest comprises two identical panels each having a row of eyelets 14 along the front center of the vest. A thong 15 may be laced through all the eyelets as shown in FIG. 1 or it may extend through only two opposed eyelets as shown in FIGS. 2 and 8, as desired.

Figure 6:
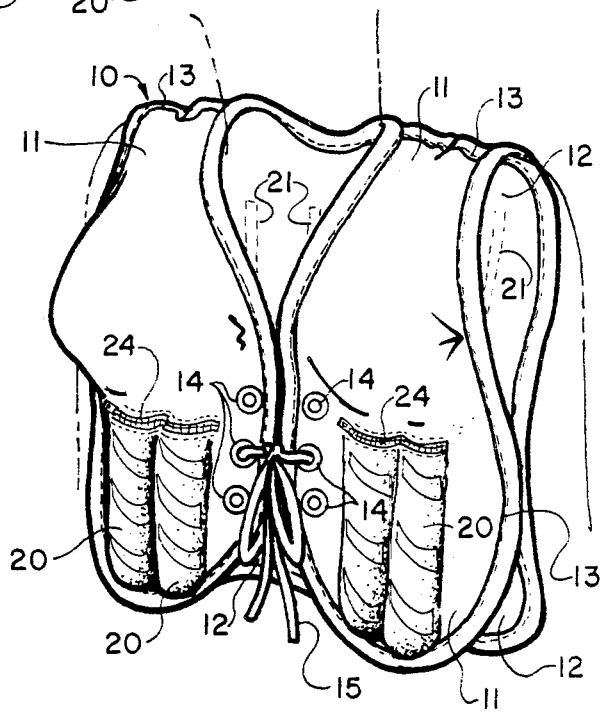
FIG. 6 is a front perspective view of a second embodiment of the invention particularly adapted for use by women.
Figure 8:
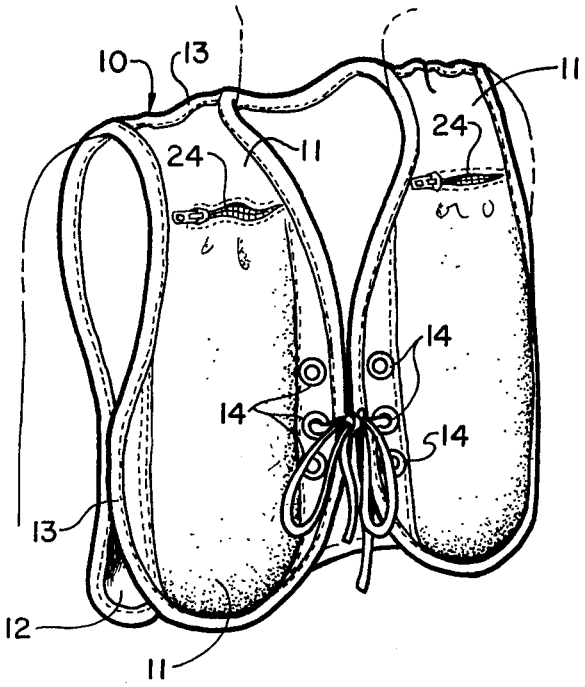
FIG. 8 is a front view of the third embodiment of the vest.
Figure 7:
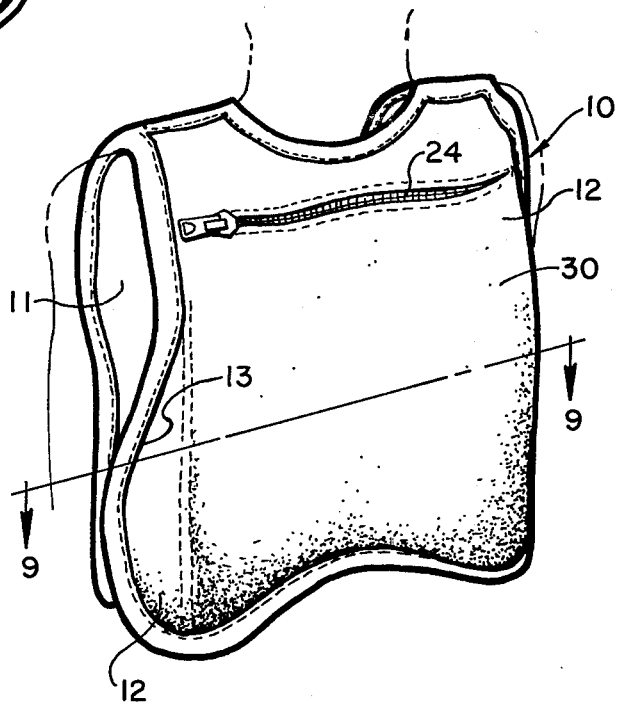
FIG. 7 is a perspective view of the rear of a third embodiment of the vest utilizing a single pocket across the back of the vest.
Figure 9:
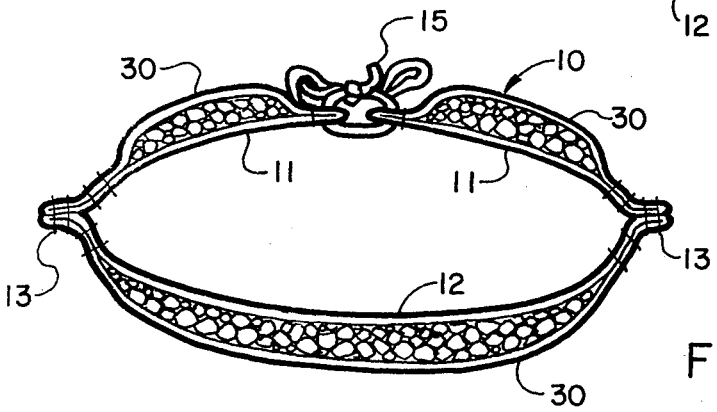
FIG. 9 is a horizontal sectional view taken substantially along the line 9—9 in FIG. 7.

The structure thus far described is common to the first embodiment illustrated in FIGS. 1–5, the second embodiment illustrated in FIG. 6, and the third embodiment illustrated in FIGS. 7–9, and like reference characters are indicated to designate corresponding parts. The first and second embodiments are alike in that they each include a plurality of tubular ribs or pockets 20 extending vertically along the back panel 12 and each of the front panels 11. The tubular ribs 20 are defined by vertically extending rows of stitches 21. The second embodiment of FIG. 6 differs from the first embodiment of FIGS. 1–5 only in that the tubular ribs 20 on each of the front panels 11 do not extend above the bustline, as they do in the first embodiment of FIGS. 1–5, and the front panels 11 in the second embodiment of FIG. 6 are tailored for use by women.

Figure 3:
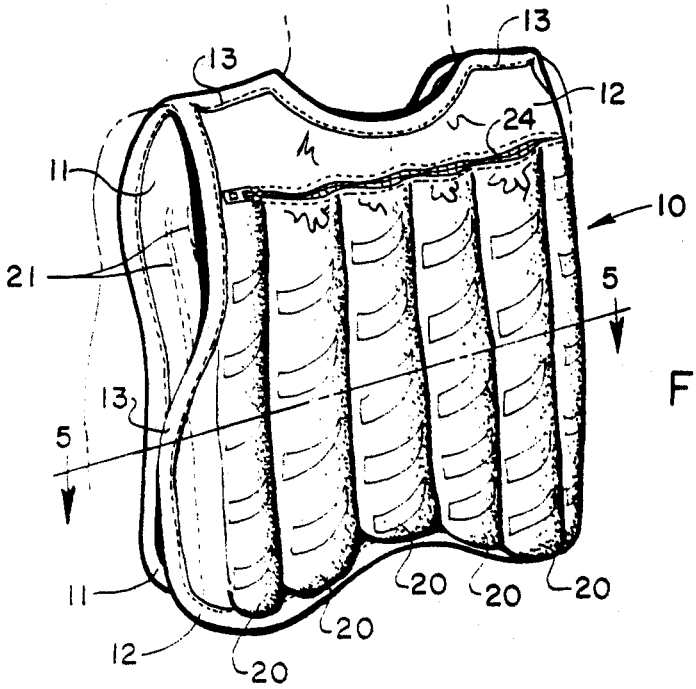
FIG. 3 is a view similar to FIG. 2 but looking at the back of the first embodiment.
Figure 4:
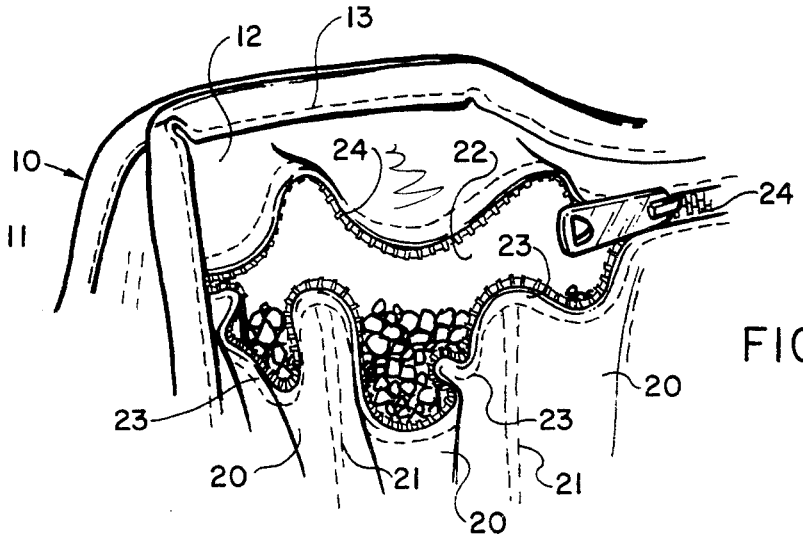
FIG. 4 is an enlarged perspective view, with parts broken away, of the upper portion of the back of the vest with the closure opened and illustrating the granular contents of the tubular ribs.
Figure 5:
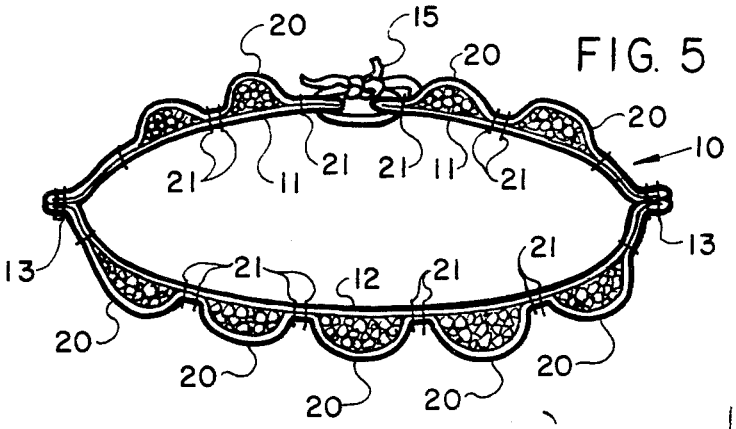
FIG. 5 is a vertical sectional view taken substantially along the line 5—5 in FIG. 3.

All of the tubular ribs 20 in the back panel 12 in the embodiments of FIGS. 1–5 preferably communicate with a common opening shown at 22 in FIG. 4 and defined by a flap 23 extending downwardly from the stitching 13 at the top of the back panel 12 and by the upper ends 23 of tubular ribs 20. The opening 22 may be closed by any desirable means such as a flap and buckle or by a zipper such as indicated at 24 in the drawings. The tubular ribs 20 on each of the front panels 11 may also communicate with common openings defined by the upper edges of the pockets and by flaps extending downwardly from the stitches 13 at the tops of panels 11, with the openings in the front panels 11 being closed as by zippers 24.

The tubular ribs 20 may be uniformly or unevenly filled with granular sand or stones or lead, coins, marbles or any other desired material to load the vest with any desired weight within a range of about one pound to about thirty pounds and evenly or unevenly distributed, as desired. Assuming that it is desired to have an evenly distributed weight of about fifteen pounds loaded in the vest, each tubular rib 20 will be filled about half full of the desired weighty material and in this event the vest will be evenly balanced on the wearer and may be only loosely held in place by a loosely tied string 15 through two opposed eyelets or may be loosely laced and tied as shown in FIG. 1.

THE THIRD EMBODIMENT

The third embodiment of the vest is illustrated in FIGS. 7–9 and differs from the first embodiment only in that the tubular ribs 20 are replaced by a single large pocket 30 on the back panel 12. The pockets on the front panels 11 may be single pockets as shown at 30 in FIG. 9 or they may be tubular ribs as shown at 20 in FIGS. 1, 2 and 5. The use of enlarged single pockets is sometimes preferred where the wearer of the vest will be frequently and quickly assuming different body attitudes and want to condition the body to react quickly and strongly to different loadings of weight as in preparation for athletic contests such as football, boxing and the like. The pockets 30 may be closed by zippers 24 in the same manner as previously described in connection with the embodiment of FIGS. 1–6.

In all illustrated embodiments the lower edge of the back panel 12 is preferably curved upwardly at 19 as shown in FIGS. 3 and 7, to insure maximum mobility by providing adequate clearance between the vest and its wearer's buttocks.

The vest 10 may be made from any desired material which is preferably air pervious for comfort such as canvas and the material from which the vest is made is preferably colored with a fluorescent and bright color which may be readily seen as a safety measure. It is contemplated that reflective strips of material may be attached to or formed integral with the vertical tubular ribs 20 on the front and back of the vest or the reflective material may be arranged in any desired pattern.

The marginal edges of the vest are preferably hemmed and padded with an absorbent material such as cotton indicated at 31 in FIG. 2. This provides a soft and absorbent marginal edge which resists cutting of the vest into the skin of the wearer which might otherwise occur because of the weight of the vest.

There is thus provided a variably weighted vest which is loosely fitted to the body and padded to provide maximum comfort and which may be weighted as desired for exercise and training.

Although specific terms have been employed in the specification they are used in a descriptive sense only and not for purposes of limitation.

I claim:

1. A variably weighted vest comprising front and rear panels, means joining the front and rear panels, together at their proximate top and side edges, the joining means at the side edges being above the waist and below the bustline of the wearer, fastening means on opposite sides of the front of the vest occupying only substantially the same horizontal plane as the joining means at the sides of the vest, pockets on the front and back panels of the vest for the reception of desired quantities of weighty material within the range of about one to about thirty pounds, and means for closing the pockets.

2. A vest according to claim 1 wherein a plurality of elongated tubular ribs are provided on the back panel.

3. A vest according to claim 1 wherein a single pocket is provided on the back panel.

4. A vest according to claim 1 wherein the vest includes marginal edges padded with a soft material to cushion the body against cutting by the weighted vest.

5. A vest according to claim 1 wherein the rear panel includes an upwardly curved lower edge.

6. A vest according to claim 2 wherein a plurality of elongated tubular ribs are provided on the front panel.

7. A vest according to claim 2 wherein a single pocket is provided on each side of the front panel.

8. A vest according to claim 2 wherein the tubular ribs on the front panel do not extend above the bustline.

9. A vest according to claim 3 wherein a single pocket is provided on each side of the front panel.

10. A vest according to claim 3 wherein a plurality of elongated tubular ribs are provided on each side of the front panel.

* * * * *